US006006703A

United States Patent [19]

Nakamura et al.

[11] Patent Number: 6,006,703

[45] Date of Patent: Dec. 28, 1999

[54] COOLING FAN FOR AN AIR-COOLED ENGINE

[75] Inventors: Shogo Nakamura; Hiroyoshi Kouchi; Kazuyuki Kobayashi; Yuji Nagase, all of Tokyo, Japan

[73] Assignee: Mitsubishi Heavy Industries, Ltd., Tokyo, Japan

[21] Appl. No.: 09/238,061

[22] Filed: Jan. 27, 1999

[30] Foreign Application Priority Data

Jan. 27, 1998 [JP] Japan ..... 10-029219

[51] Int. Cl.[6] ..... F01P 7/04

[52] U.S. Cl. ..... 123/41.65; 416/60

[58] Field of Search ..... 123/41.65, 41.63, 123/41.49; 416/60

[56] References Cited

U.S. PATENT DOCUMENTS 3,905,822 9/1975 Kiefer ..... 416/241

3,952,712 4/1976 Hermanson ..... 123/41.65

FOREIGN PATENT DOCUMENTS 55-70252 U 5/1955 Japan .

6-58125 U 8/1994 Japan .

9-250348A 9/1997 Japan .

*Primary Examiner*—Noah P. Kamen

*Attorney, Agent, or Firm*—Evenson, McKeown, Edwards & Lenahan, P.L.L.C.

[57] ABSTRACT

A cooling fan made of synthetic resin for an air-cooled engine which is fixedly secured to a side of the body of a flywheel includes a plurality of cooling fins formed along a circumferential direction thereof, and a circular reinforcement rib projecting axially from the periphery of a backboard, thereby reducing deformation of the fan during running of the engine and preventing deformation of the fan during transportation, without significantly increasing the weight of the fan.

6 Claims, 3 Drawing Sheets

COOLING FAN FOR AN AIR-COOLED ENGINE

BACKGROUND OF THE INVENTION

1. Field of the Invention

This invention relates cooling fan made of synthetic resin, and more particularly to an improved cooling fan formed as a single unit with a flywheel for a small, general-purpose air-cooled engine.

2. Description of the Prior Art

A cooling fan for a general-purpose small air-cooled engine to be used in industry, farming and so forth is conventionally made of cast iron or an aluminum alloy casting formed with a flywheel as a single unit. Recently, a cooling fan molded from thermoplastic synthetic resin material adapted to be secured to a side of the flywheel has been employed instead because there has been a demand to increase the number of cooling fins which has complicated the configuration of the cooling fins and made molding by metal casting difficult.

Referring to FIG. 4, there is shown, by way of an example, a conventional cooling fan of this type made of synthetic resin, which has been proposed by this applicant in Japanese utility model application Sho 55-70252.

In FIG. 4, the components including a flywheel body 'a', a fan of synthetic resin '$a_2$' and a starting belt pulley 'd' are joined together as a single unit by a plurality of bolts 'g'. The reference symbol 'h' represents a spacer. The flywheel body 'a' and the fan 'a2' are fixedly secured to a crankshaft 'b' of an engine by a nut 'e'. The fan '$a_2$' secured to the flywheel body 'a' rotates synchronously with the revolution of an engine, thereby functioning as a centrifugal blower which draws in cooling air and cools the cylinders and cylinder heads.

Other single-unit-type flywheel cooling fans comprising a cooling fan formed as a single unit with a flywheel which are different from the cooling fan of FIG. 4 have been proposed in the Japanese patent laid-open publication Hei 9-250348 or the Japanese utility model laid-open publication Hei 6-58125. According to the invention of the publication Sho 9-250348, a cooling fan made of synthetic resin is fixedly secured to a flywheel together with a starting belt pulley by a clamping bolt secured to a crankshaft. In the device of the publication Hei 6-58125, a cooling fan made of synthetic resin is fixed to a cast metal flywheel by a plurality of bolts.

Conventional synthetic resin cooling fans, such as those disclosed in the above-mentioned Japanese utility model application Sho 55-70252 (FIG. 4), the patent laid-open publication Hei 9-250348, or the utility model laid-open publication Hei 6-58125, have the disadvantage that the fans tend to be deformed as a result of softening caused by the heat produced in an engine and the negative wind pressure produced during running of the engine. As a result, the cooling fan '$a_2$' bends backwardly toward an inner side (i.e., the cooling fin side) so that the cooling fan may come into contact with a wind guide plate or a cooling air duct. In the past, several proposals have been made in order to resolve this disadvantage. The spacing between the cooling air duct and the fan '$a_2$' (FIG. 4) has been kept wide in one proposal from which unfavorably degrades the blowing characteristics of the fan '$a_2$'. Another proposal is to increase the thickness of the backboard '$a_3$' of the fan '$a_2$' or to dispose a reinforcement rib on a back wall of the backboard '$a_3$' to increase the strength of the fan '$a_2$'. Still another proposal is to extend the fins toward the center to increase the rigidity of the fan '$a_2$'. These conventional cooling fan constructions, however, unfavorably increase the weight of the cooling fans and complicate the configurations of the fans.

In conventional cooling fans made of synthetic resin, the back wall of the backboard '$a_3$' is flat, resulting in the disadvantages that it is easy for the backboard to slip, and that the fan is liable to be deformed during transportation when many fans are randomly packed into a box.

SUMMARY OF THE INVENTION

It is therefore a primary object of this invention to provide a cooling fan for a small, general purpose air-cooled engine made of synthetic resin and formed with a flywheel, which reduces deformation of the fan during running of the engine and prevents deformation of the fan during transportation without significantly increasing the weight of the fan.

According to a first aspect of this invention, a synthetic resin cooling fan for an air-cooled engine is provided which is fixedly secured to a side of a flywheel body and which has a plurality of cooling fins formed along a circumferential direction thereof and an axially projecting circular reinforcement rib arranged on a peripheral portion of its backboard. According to this first aspect of this invention, the rigidity of the cooling fan is increased by the reinforcement rib, even if it is softened to some extent by heat produced during running of the engine. The rib resists deformation by wind pressure so as to maintain a reasonable spacing between the cooling fan and a cooling air duct and prevent the cooling fan from coming into contact with the cooling air duct as a result of deformation of the fan. Moreover, the cooling fan is simply provided with the circular reinforcement rib, thereby increasing the rigidity with a simple construction with a minor increase in weight.

According to a second aspect of this invention, there is provided a cooling fan for an air-cooled engine according to the first aspect of this invention in which the reinforcement rib is formed to have an inside diameter which is slightly larger than the outside diameter of the cooling fins so that, when a pair of the cooling fans are stacked or nested, the cooling fins of one of the cooling fans may be received within the inside diameter of the reinforcement rib of the other fan.

According the second aspect of this invention, when a pair of the cooling fans are stacked or overlapped, the outside diameter of the cooling fins of one cooling fan may be received within the inside diameter of the reinforcement rib of the other fan, thereby increasing the volume efficiency in packing for transportation and avoiding a decrease in fan performance due to deformation of the fins of many overlapped cooling fans.

BRIEF DESCRIPTION OF THE DRAWINGS

A better understanding of this invention may be had from a consideration of the following detailed description, taken in conjunction with the accompanying drawings in which.

DESCRIPTION OF THE PREFERRED EMBODIMENTS

As an example, a preferred embodiment of this invention will be described in detail hereinafter with reference to the accompanying drawings. Dimensions, material, configuration, and the relative arrangement of the components described in this embodiment are described only for explanation and do not limit the scope of this invention unless specifically so stated.

Figure 1:
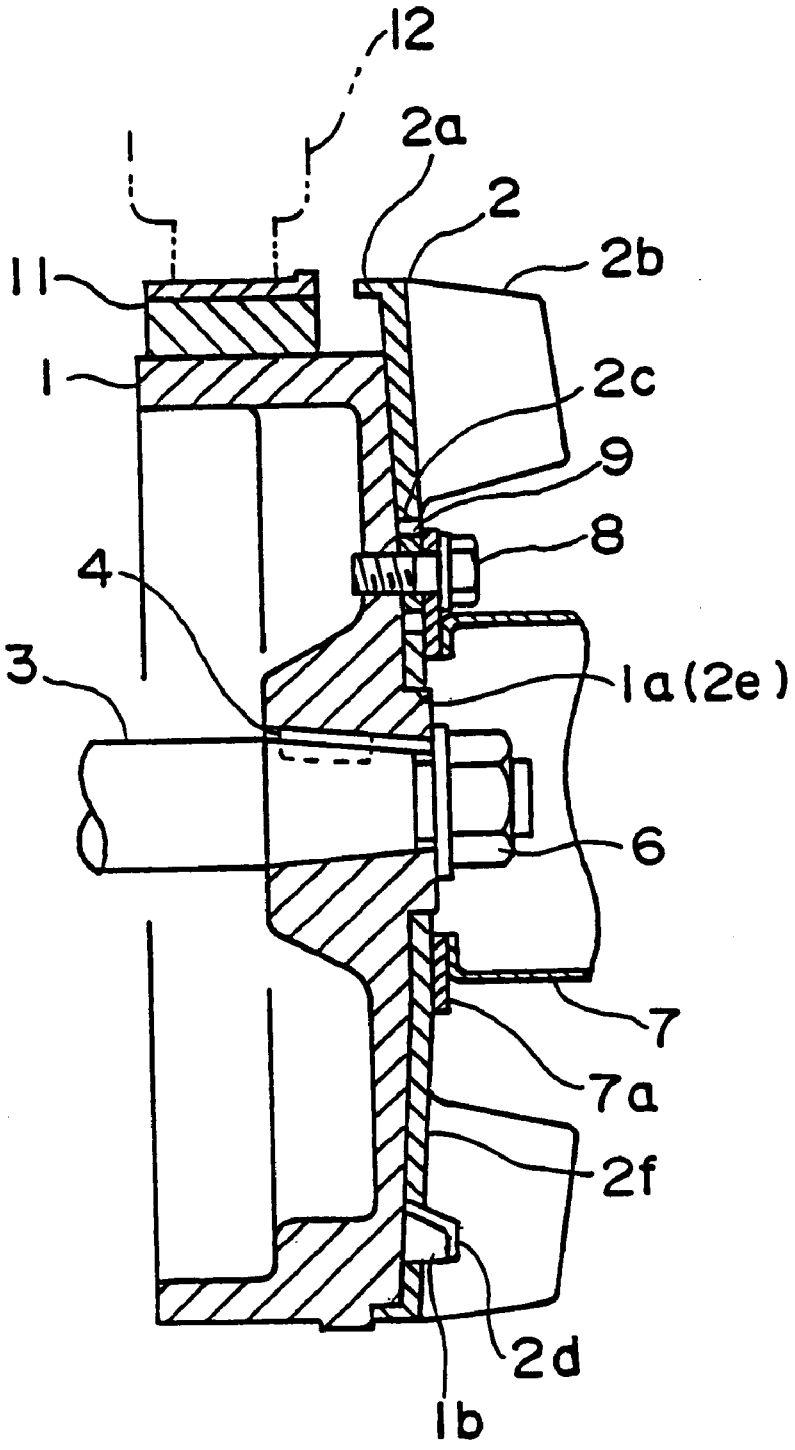
FIG. 1 is a sectional view taken along an axial line of a cooling fan formed with a flywheel according to a preferred embodiment of this invention for a general purpose air cooled engine.
Figure 2:
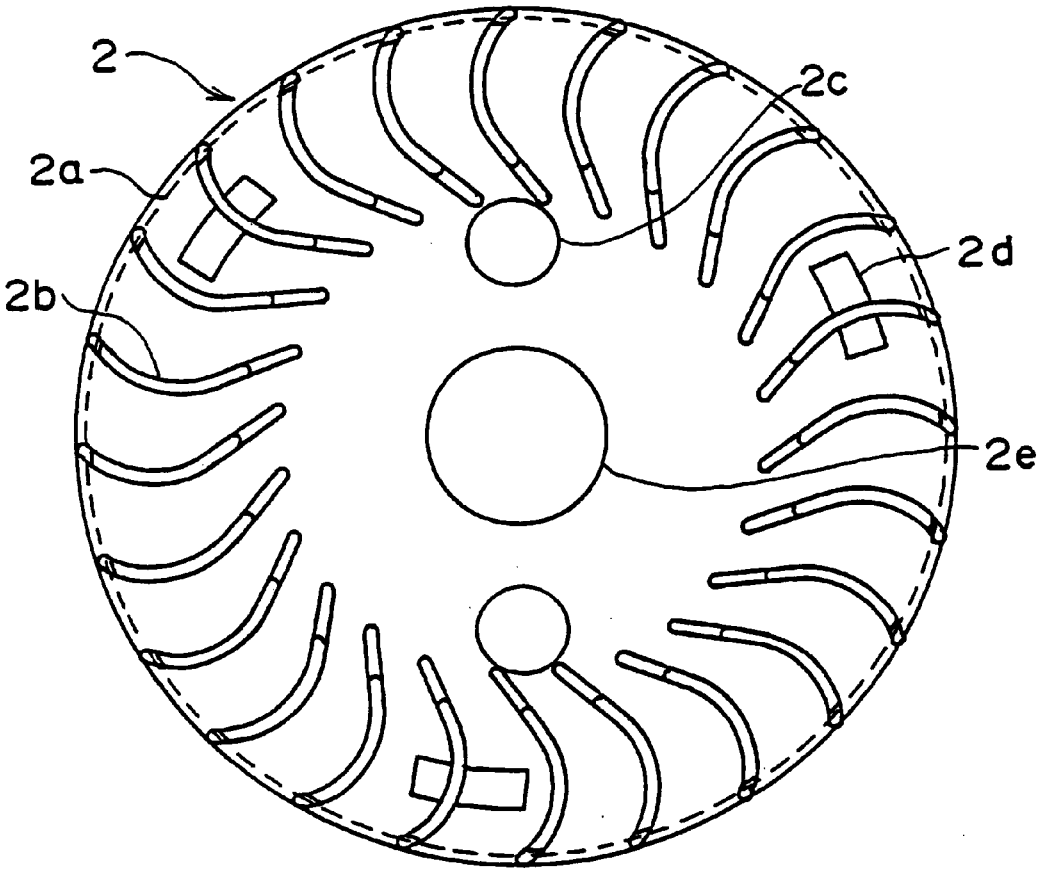
FIG. 2 is a front view of the cooling fan of FIG. 1.

Referring to FIG. 1, there is shown a sectional view taken along an axial line of a crankshaft of a cooling fan according to this embodiment formed with a flywheel for a general purpose air cooled engine. FIG. 2 shows its front view and FIG. 3 shows a sectional view of a pair of cooling fans stacked or nested with each other.

FIGS. 1 and 2 show a flywheel body 1 of cast iron and a cooling fan 2 of synthetic resin. A mounting flange 7*a* of a pulley 7 for a recoil starter is formed with the pulley 7 as a single unit. The flywheel body 1, the cooling fan 2, and the mounting flange 7*a* are joined together as a single unit through a spacer 9 by a plurality of bolts 8. Loopholes 2*c* are formed outside the spacer 9 to avoid the bolts 8. A center hole 2*e* of the cooling fan 2 engages with a step 1*a* of the flywheel body 1, and for alignment, a plurality of (for example, three) projections 1*b* disposed on the side of the flywheel body 1 at equal angular spacings around the periphery are received in a corresponding number of rectangular holes 2*d* disposed at the periphery in the side of the cooling fan 2 at equal angular spacings around the circumference thereof, thereby fixedly securing the cooling fan 2 to the flywheel body 1 in a rotary direction.

A cylindrical or annular reinforcement rib 2*a* is disposed adjacent the periphery of the cooling fan 2, projecting in an axial direction from a backboard 2*f* toward the flywheel body 1. A plurality of fins 2*b* are disposed on the backboard 2*f* of the cooling fan 2 at equal intervals in a circumferential direction.

Figure 3:
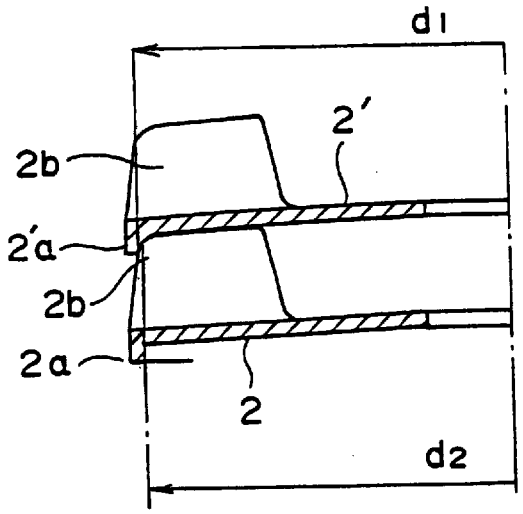
FIG. 3 is a sectional view of a pair of cooling fans according to this embodiment which have been stacked or nested with each other.
Figure 4:
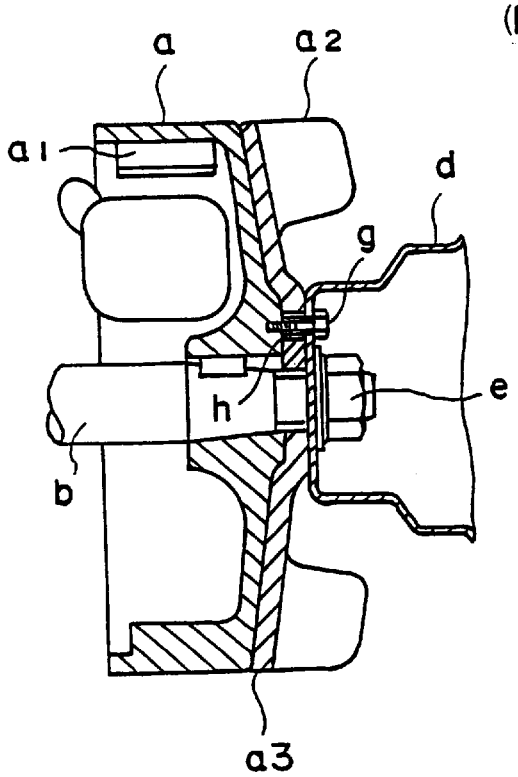
Fig. 4 (PRIOR ART)
FIG. 4 is a sectional view of a conventional cooling fan formed with a flywheel.

As shown in FIG. 3, the reinforcement rib 2*a* is so designed that its inside diameter $d_1$ is a little larger than the outside diameter $d_2$ of the cooling fins 2*b* to avoid deformation of the fan when it is packed in boxes as described hereinafter.

The rotary position of the flywheel body 1 is fixed by a key 4, and the flywheel body is fixedly secured to a crankshaft 3 by a nut 6 which is tightened thereon. Mounted on the flywheel body 1 is a magnet 11 which changes the magnetic flux of an iron core within a coil 12 fixedly disposed on a side of an engine housing as the flywheel body 1 rotates, thereby generating current for ignition in the coil 12.

The flywheel with the flywheel body 1 and the cooling fan 2 absorbs and dissipates the vibrational torque of the crankshaft 3 of the engine due to the inertial weight of the wheel, and at the same time it serves a centrifugal blower function so that the cooling fan 2 disposed on the flywheel body 1 forcefully delivers cooling air to cool a cylinder and a cylinder head of the engine.

During running of an engine provided with a flywheel constructed in this manner, even if the cooling fan 2 made of synthetic resin is softened a little by heat produced in the engine, the cooling fan 2 is provided with the cylindrical reinforcement rib 2*a* having a predetermined height at the periphery of the backboard 2*f*, allowing the rigidity to be increased by the reinforcement rib 2*a* so as to avoid deformation of the cooling fan 2 caused by negative wind pressure in delivering air. Thus, the cooling fan 2 is prevented from bending backward to the inside (i.e., toward the cooling fins 2*b*) causing the fins 2*b* to come into contact with a cooling air duct. Accordingly, the distance between the cooling air duct and the cooling fan 2 is properly maintained, and any degradation of the fan blast characteristics may be avoided.

Thus, according to this embodiment, the cooling fan 2 is provided with only a small reinforcement rib 2*a*, resulting in simplification of the fan configuration and only a minor increase in the weight of the cooling fan 2.

FIG. 3 shows a pair of cooling fans 2 and 2' having the same configuration which are overlapped or nested. The inside diameter $d_1$ of a reinforcement rib 2*a* of the cooling fan 2' is slightly larger than the outside diameter $d_2$ of cooling fins 2*b* of the cooling fan 2. This will allow the cooling fans to be easily stacked nested with each other to reduce the falling of a load, especially when the fan has many components. Accordingly, packing the fans in boxes for transportation by so overlapping or nesting the cooling fans 2 and 2' improves the volume efficiency in comparison to random loading, and may avoid deformation of cooling fans 2 against rolling in transportation because no partial unbalanced force is applied to the cooling fans.

If desired, the spacer 9 of this embodiment may be formed as a single unit with the pulley mounting flange 7*a* or the flywheel body 1.

Therefore, according to this invention as described above, during running of the engine, even if the cooling fan is softened a little by heat produced in the engine, the rigidity of the cooling fan is increased by the reinforcement rib disposed at the periphery of the cooling fan backboard so as to avoid deformation of the cooling fan by negative wind pressure as it blows air, so that the cooling fan is prevented from bending inwardly and backwardly and coming into contact with a cooling air duct.

According to this invention, the distance between the cooling air duct and the cooling fan 2 may be properly maintained, thereby allowing the blast characteristics of the cooling fan to be sustained in a good condition. Only a small reinforcement rib is added to the cooling fan, providing a simple configuration, a minor increase in weight of the fan, and reduced cost.

According to this invention, the inside diameter of the reinforcement rib is designed so as to be easily nested with the outside diameter of cooling fins of the cooling fan, and thus, will reduce the possibility of the fans falling against each other, especially when the fan has many components. This arrangement will also avoid deformation of the cooling fans when packed in boxes for transportation, and improve the volume efficiency, so that the cost for packing in boxes and its transportation may be reduced.

We claim:

1. A cooling fan for attachment to a side of a flywheel for an air-cooled engine, said fan being made of synthetic resin material and comprising:

a circular backboard;

a plurality of cooling fins distributed uniformly around the circumference of the circular backboard; and an annular reinforcing rib projecting axially from the periphery of the backboard;

wherein said reinforcement rib has an inside diameter which is slightly larger than an outside diameter of said cooling fins so that, when a pair of said cooling fans are stacked, the cooling fins of one of the fans may be nestingly received within the inside diameter of the reinforcement rib of the other fan.

2. A package comprising a plurality of synthetic resin cooling fans for an air cooled engine stacked one above another, each of said cooling fans comprising a circular backboard, a plurality of cooling fins uniformly spaced around the circumference of the backboard, and an annular reinforcement rib projecting axially from the periphery of the backboard, said reinforcement rib having an inside diameter which is slightly larger than an outside diameter of said cooling fins so that the cooling fins of one of said cooling fans may be nestingly received within the inside diameter of the reinforcement rib of another cooling fan stacked adjacent thereto, wherein faces of end tips of said fins contact the backboard of the other cooling fan when stacked and are shaped so as to be engaged by face to face contact with said backboard.

3. In combination, an air-cooled engine having a crankshaft, a flywheel mounted on said crankshaft, and a cooling fan made of synthetic resin fixedly secured to a side of said flywheel;

said cooling fan comprising a backboard, a plurality of cooling fins distributed uniformly around the circumference of the backboard, and an annular reinforcement rib projecting axially from the periphery of said backboard;

wherein said reinforcement rib has an inside diameter which is slightly larger than an outside diameter of said cooling fins.

4. A packing method for nesting a plurality of stacked cooling fans each comprising a backboard, a plurality of cooling fins arranged uniformly around the circumference of the backboard, and an annular reinforcement rib projecting axially from the periphery of the backboard, said reinforcement rib having an inside diameter which is slightly larger than an outside diameter of said cooling fins so that the cooling fins of one fan may be nestingly received within the inside diameter of the reinforcement rib of another, adjacently stacked cooling fan, faces of end tips of said fins contacting the backboard of the other cooling fan when stacked and being shaped so as to be engaged by face to face contact with said backboard.

5. A cooling fan for attachment to a side of a flywheel for an air-cooled engine, said fan being made of synthetic resin material and comprising:

a plurality of cooling fins distributed uniformly around the circumference of a circular backboard; and an annular reinforcing rib projecting axially from a periphery of the blackboard;

said annular reinforcing rib having an inner side face with a smooth surface so that the cooling fan may be pulled axially and detached from the outer circumference of the flywheel.

6. In combination, an air cooled engine having a crankshaft, a flywheel mounted on said crankshaft, and a cooling fan made of synthetic resin fixedly secured to a side of said flywheel;

said cooling fan comprising a backboard, a plurality of cooling fins distributed uniformly around the circumference of the backboard, and an annular reinforcement rib projecting axially from the periphery of said backboard;

an inner side face of said annular reinforcement rib having a smooth surface so that the cooling fan may be pulled axially and detached from a side of a flywheel.

* * * * *